US010062349B2

(12) United States Patent
Choi et al.

(10) Patent No.: US 10,062,349 B2
(45) Date of Patent: Aug. 28, 2018

(54) DISPLAY DEVICE AND DRIVING METHOD THEREOF

(71) Applicant: SAMSUNG DISPLAY CO., LTD., Yongin, Gyeonggi-Do (KR)

(72) Inventors: Utah Choi, Hwaseong-si (KR); Hyo-Chul Lee, Cheonan-si (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 924 days.

(21) Appl. No.: 14/532,480

(22) Filed: Nov. 4, 2014

(65) Prior Publication Data

US 2015/0379954 A1 Dec. 31, 2015

(30) Foreign Application Priority Data

Jun. 25, 2014 (KR) ..... 10-2014-0078099

(51) Int. Cl.
*G09G 3/36* (2006.01)

(52) U.S. Cl.
CPC ..... *G09G 3/3696* (2013.01); *G09G 3/3611* (2013.01); *G09G 3/3655* (2013.01); *G09G 2310/08* (2013.01); *G09G 2320/0247* (2013.01); *G09G 2320/0257* (2013.01); *G09G 2330/026* (2013.01)

(58) Field of Classification Search
CPC .. G09G 3/3696; G09G 3/3611; G09G 3/3655; G09G 2310/08; G09G 2320/0247; G09G 2320/0257; G09G 2330/026
See application file for complete search history.

(56) References Cited

U.S. PATENT DOCUMENTS

2010/0033414 A1* 2/2010 Jeong ..... G09G 3/3655 345/89
2010/0214309 A1* 8/2010 Bae ..... G09G 3/3655 345/589
2010/0309173 A1* 12/2010 Matsuda ..... G09G 3/3674 345/204
2011/0310135 A1* 12/2011 Feng ..... G09G 3/3648 345/690
2012/0081352 A1* 4/2012 Yamagishi ..... G09G 3/3614 345/212
2014/0293180 A1 10/2014 Hong et al.
2016/0171937 A1* 6/2016 Xu ..... G09G 3/36 345/212

FOREIGN PATENT DOCUMENTS

KR 10-2007-0028021 A 3/2007
KR 10-2007-0052148 A 5/2007
KR 10-2008-0061096 A 6/2008
KR 20080061096 A * 7/2008
KR 10-2009-0058982 A 6/2009
KR 10-2014-0119512 10/2014

* cited by examiner

*Primary Examiner* — Mark Edwards
(74) *Attorney, Agent, or Firm* — Lee & Morse, P.C.

(57) ABSTRACT

A display device includes a liquid crystal display and a power supply to apply a common voltage to a common electrode of the display. The power supply applies a first common voltage to the common electrode for a first period after power is turned on, and applies a second common voltage higher than the first common voltage to the common electrode until the power is turned off after the first period.

20 Claims, 11 Drawing Sheets

500

DISPLAY DEVICE AND DRIVING METHOD THEREOF

CROSS-REFERENCE TO RELATED APPLICATION

Korean Patent Application No. 10-2014-0078099, filed on Jun. 25, 2014, and entitled, "Display Device and Driving Method Thereof," is incorporated by reference herein in its entirety.

BACKGROUND

1. Field

One or more embodiments described herein relate to a display device and a driving method thereof.

2. Description of the Related Art

A liquid crystal display (LCD) includes a liquid crystal layer between two display panels. An image is generated based on an electric field applied to the liquid crystal layer. This field is generated based on a voltage applied to field generating electrodes (e.g., a pixel electrode and a common electrode) on the display panels. When the field is applied, the alignment direction of liquid crystal molecules in the liquid crystal layer is controlled.

An LCD may be driven in a variety of inversion modes, where the polarity of a data voltage applied to the pixel electrode is periodically inverted with respect to a common voltage. In a frame inversion mode, the polarity of a data voltage with respect to a common voltage is inverted for each frame. In line inversion mode, the polarities of data voltages with respect to a common voltage for adjacent pixels are inverted in a row direction or column direction. In a dot inversion mode, the polarities of data voltages with respect to a common voltage for adjacent pixels are inverted in a row direction and column direction.

However, when the LCD is driven for a long time, a driven pattern may affect the transmittance in a way that deteriorates display quality. Also, when the same pattern is continuously displayed, a residual afterimage of the pattern may remain.

SUMMARY

In accordance with one embodiment, a display device includes a display including a plurality of pixels, each including a liquid crystal layer between a pixel electrode and a common electrode; and a power supply to apply a common voltage to the common electrode, wherein the power supply is to apply a first common voltage to the common electrode for a first period after power is turned on, and is to apply a second common voltage higher than the first common voltage to the common electrode until the power is turned off after the first period.

The first common voltage may be set to a voltage to reduce a residual image, and the second common voltage may be set to a voltage to reduce flicker at a predetermined gray scale value. The power supply may increase the first common voltage to the second common voltage at a predetermined rate for a predetermined second period.

The device may include a flag signal generator to measure the first period from at least one of a clock signal or a scan start signal, and to generate a flag signal for instructing generation of one of the first common voltage or the second common voltage.

The device may include a memory to store a flag parameter determined by a driving period for which the second common voltage is applied. The flag signal generator may set the flag parameter to 1 for instructing generation of the first common voltage when the driving period for which the second common voltage is applied exceeds a predetermined third period, and set the flag parameter to 0 for instructing generation of the second common voltage when the driving period does not exceed the third period.

The flag signal generator may read the flag parameter from the memory when the power supply is turned on, and may transmit the first flag signal for generating the first common voltage when the flag parameter is set to 1 or transmit the second flag signal for generating the second common voltage when the flag parameter is set to 0 to the power supply.

The device may include a residual image evaluator to evaluate whether a condition for generating a residual image is satisfied by detecting whether identical image signals are received for a plurality of frames; and a memory to store a flag parameter determined by whether the condition for generating a residual image is satisfied.

The residual image evaluator may set the flag parameter to 1 for instructing the generation of the first common voltage when image signals input to a dot at a specific location are identically received for a predetermine number of frames, and set the flag parameter to 0 for instructing the generation of the second common voltage when the image signals input to the dot at the specific location are differently received for a plurality of frames.

The flag signal generator may read the flag parameter from the memory when the power supply is turned on, and transmit the first flag signal for generating the first common voltage when the flag parameter is set to 1, or transmit the second flag signal for generating the second common voltage when the flag parameter is set to 0 to the power supply unit.

The power supply may include a first resistor including a first end coupled to an input terminal to which the flag signal is input and a second end coupled to a first node; a first capacitor including a first electrode coupled to the first node and a second electrode coupled to a reference potential; a switching transistor including a gate electrode coupled to the first node and a first electrode coupled to a second node; a second resistor including a first end coupled to a second electrode of the switching transistor and a second end coupled to the reference potential; a third resistor power including a first end coupled to a power supply voltage and a second end coupled to the second node; a fourth resistor including a first end coupled to the second node and a second end coupled to the reference potential; and a first differential amplifier to output a first differential voltage between a voltage of the second node and a reference voltage.

The power supply may include a second capacitor having a first electrode coupled to the second node and a second electrode coupled to the reference potential.

The power supply may include a second differential amplifier which includes a first input terminal to which the first differential voltage is input; a second input terminal to which the power supply voltage is input; and an output terminal to output, as the common voltage, a second voltage based on a difference between the first differential voltage and the power supply voltage.

The power supply may include a fifth resistor coupled between the power supply voltage and a second input terminal of the second differential amplifier; and a sixth resistor coupled between the second input terminal of the second differential amplifier and an output terminal of the second differential amplifier.

In accordance with another embodiment, a method for driving a liquid crystal display device includes applying a first common voltage to a common electrode for a first period after a power supply is turned on; and applying a second common voltage higher than the first common voltage to the common electrode until the power supply is turned off after the first period.

The method may include increasing the first common voltage to the second common voltage at a predetermined rate for a predetermined second period. The method may include setting a flag parameter to 1 for instructing generation of the first common voltage when a driving period, for which the second common voltage is applied, exceeds a predetermined third period, and setting the flag parameter to 0 for instructing generation of the second common voltage when the driving period exceeds the third period.

The method may include applying the first common voltage to the common electrode for the first period after the power supply is turned on includes transmitting a first flag signal for instructing the generation of the first common voltage when the flag parameter is set to 1 when the power supply is turned on to the power supply.

The method may include applying the first common voltage to the common electrode for the first period after the power supply is turned on is omitted when the flag parameter is set to 0 when the power supply is turned on.

The method may include setting the flag parameter to 1 for instructing the generation of the first common voltage when image signals input to a pixel at a specific location are identically received for a predetermined number of frames, and setting the flag parameter to 0 for instructing the generation of the second common voltage when the image signals input to the pixel at the specific location are differently received for a plurality of frames.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
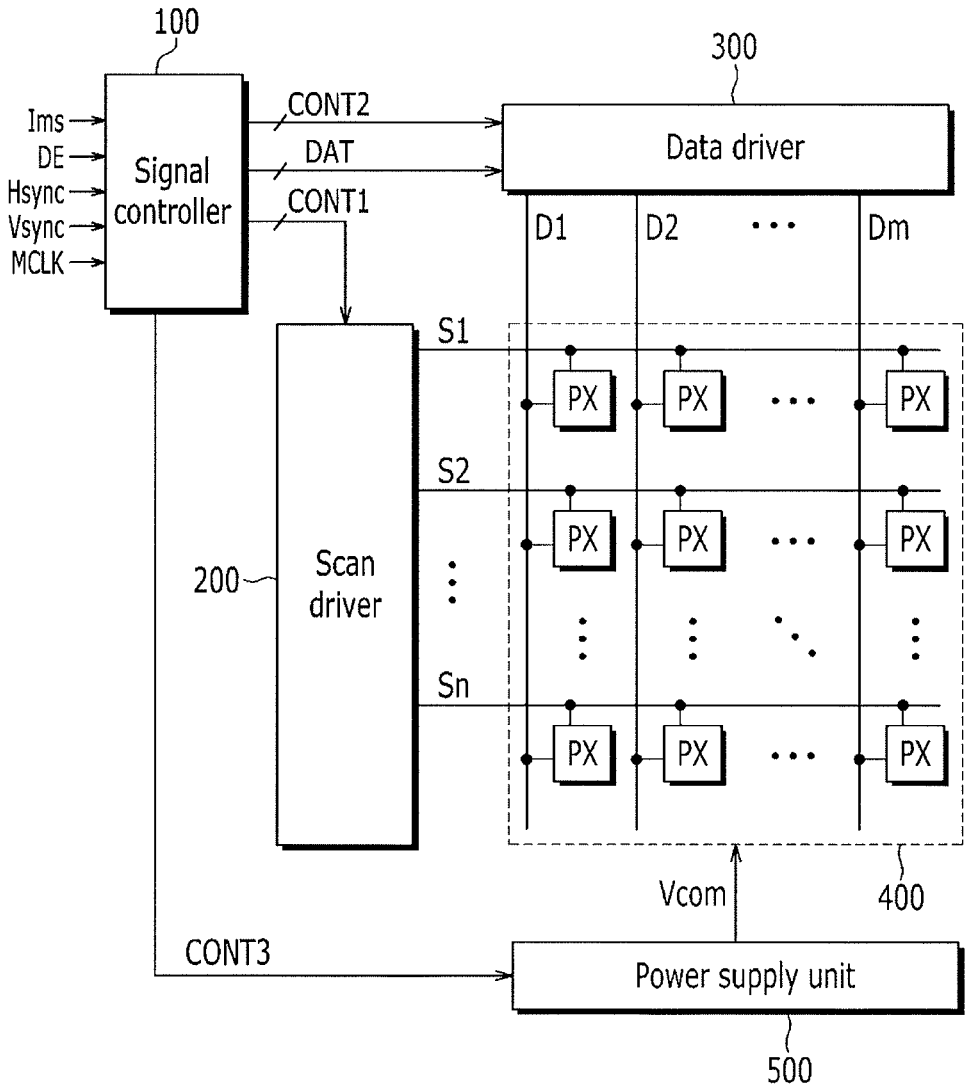
FIG. 1 illustrates an embodiment of a display device.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawings, the dimensions of layers and regions may be exaggerated for clarity of illustration. Also, like reference numerals refer to like elements throughout. Also, when it is described that an element is "coupled" to another element, the element may be "directly coupled" to the other element or "electrically coupled" to the other element through a third element.

FIG. 1 illustrates an embodiment of a display device which includes a signal controller 100, a scan driver 200, a data driver 300, a display unit 400, and a power supply unit 500. The display unit 400 includes a plurality of scan lines S1 to Sn, a plurality of data lines D1 to Dm, and a plurality of pixels PX.

The pixels PX are coupled to the signal lines S1 to Sn and D1 to Dm and are arranged in a matrix. The scan lines S1 to Sn extend in a row direction and are substantially parallel to each other. The data lines D1 to Dm extend in a column direction and are substantially parallel to each other.

Figure 2:
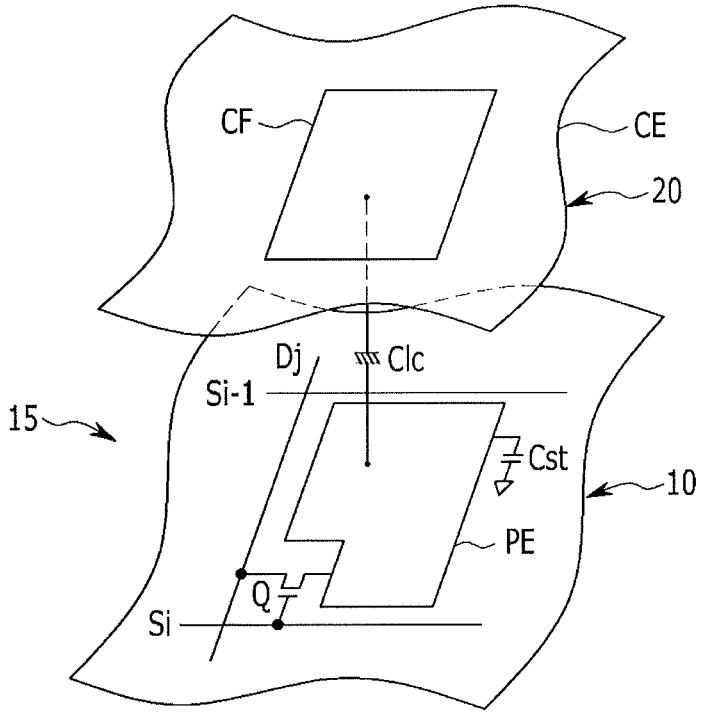
FIG. 2 illustrates an embodiment of a pixel.

The display unit 400 may be a liquid crystal panel assembly, which includes a thin film transistor array panel (e.g., reference numeral 10 in FIG. 2), a common electrode panel facing the thin film transistor array panel (reference numeral 20 in FIG. 2), and a liquid crystal layer between the display panels 10 and 20 (reference numeral 15 in FIG. 2). One or more polarizers may be coupled to outer surfaces of the display unit 400 to polarize light.

The signal controller 100 receives an image signal ImS and an input control signal for controlling display of the image signal Ims. The image signal ImS includes luminance information for the pixels. The luminance may be expressed, for example, as a predetermined number of gray scale values, e.g., $1024=2^{10}$, $256=2^{8}$, or $64=2^{6}$.

The input control signal may include a data enable signal DE, a horizontal synchronization signal Hsync, a vertical synchronization signal Vsync, and a main clock signal MCLK. The signal controller 100 transmits an image data signal DAT and a data control signal CONT2 to the data driver 300.

The data control signal CONT2 controls operation of the data driver 300. In one embodiment, the data control signal CONT2 includes a horizontal synchronization start signal STH for instructing transmission start of the image data signal DAT, an output signal TP for instructing the plurality of data lines D1 to Dm to output a data signal, and a data clock signal HCLK. The data control signal CONT2 may further include a reverse signal RVS for reversing a voltage polarity of the image data signal DAT with respect to a common voltage Vcom.

The signal controller 100 transmits a scan control signal CONT1 to the scan driver 200. The scan control signal CONT1 controls operation of the scan driver 200. In one embodiment, the scan control signal CONT1 includes at least one clock signal CLK for controlling outputs of a scan start signal STV and a gate-on voltage at the scan driver 200. The scan control signal CONT1 may further include an output enable signal OE that limits duration of the gate-on voltage.

The signal controller 100 transmits a power supply control signal CONT3 to the power supply unit 500. The power supply control signal CONT3 controls operation of the power supply unit 500.

The data driver 300 is coupled to the data lines D1 to Dm arranged in the display unit 400, and selects a gray scale voltage corresponding to the image data signal DAT.

The data driver 300 applies the selected gray voltage, as a data signal, to the data lines D1 to Dm. The data driver 300 may generate gray scale voltages for all gray scale values, for example, by dividing a predetermined number of reference gray scale voltages and then selecting the gray scale voltage which corresponds to the image data signal DAT.

The scan driver 200 is coupled to the scan lines S1 to Sn that are arranged in the display unit 400, and applies a scan signal including a combination of a gate-on voltage for turning on a switching element (Q in FIG. 2) and a gate-off voltage for turning off the switching element to the scan lines S1 to Sn. The scan driver 200 may sequentially apply the scan signal of the gate-on voltage to the scan lines S1 to Sn.

The power supply unit 500 provides the common voltage Vcom to the display unit 400 depending on the power supply control signal CONT3. For example, the power supply unit 500 may apply a first common voltage to a common electrode (CE in FIG. 2) for a first period after the power supply is turned on, and may apply a second common voltage higher than the first common voltage to the common electrode until the power supply is turned off after the first period.

The power supply unit 500 may slowly increase the first common voltage to the second common voltage for a predetermined second period. The second common voltage may correspond, for example, to a predetermined or optimal common voltage at which flicker is minimized at full white, e.g., the highest gray scale value. For example, the highest gray scale value is applied to the display device, and the common voltage is applied to the display device to which the highest gray scale value is applied.

In this case, the flicker of the display device is measured while adjusting the common voltage, so that the common voltage at which the flicker is minimized or reduced may be set to the predetermined or optimal common voltage.

The first common voltage is a predetermined voltage to reduce or minimize a residual image. For example, when a still image is displayed on the display device for a predetermined time, the residual image remains even when the display device is turned off or turned on again. In this case, the same gray scale value(s) as that of the still image or intermediate gray scale value(s) is/are applied to the display device, and the common voltage is adjusted to measure the residual image of the display device. The common voltage at which the residual image disappears may be set to the first common voltage that reduces or minimizes the residual image.

The signal controller 100, the scan driver 200, and the data driver 300 described above may be directly mounted on the display unit 400 or on the flexible printed circuit film as at least one IC chip, and may be attached to the display unit 400, for example, as a tape carrier package, or may be mounted on an additional printed circuit board.

Alternatively, the signal controller 100, the scan driver 200, and the data driver 300 may be integrated into the display unit 400 along with the scan lines S1 to Sn and the data lines D1 to Dm. For example, a function of the scan driver 200 may be performed by an amorphous silicon gate in the display unit 400. In addition, the data driver 300 may be provided as a driving integrated circuit, in which a function of the signal controller 100 is internally integrated.

FIG. 2 illustrates an embodiment of a pixel PX, which, for example, may be included in the display unit 400 of FIG. 1. For illustrative purposes, the pixel PX is coupled to an i-th scan line S1 and a j-th data line Dj, where ($1<i\leq n$, $1\leq j\leq m$).

The pixel PX includes a switching element Q, a liquid crystal capacitor Clc, and a storage capacitor Cst. The switching element Q is a three terminal element (e.g., a thin film transistor) provided in the thin film transistor array panel 10. The switching element Q includes a gate terminal coupled to one of the scan lines S1 to Sn, an input terminal coupled to one of the data lines D1 to Dm, and an output terminal coupled to one of the liquid crystal capacitor Clc or the storage capacitor Cst. The thin film transistor includes, for example, amorphous silicon or polysilicon.

If implemented as a thin film transistor, this transistor may be an oxide thin film transistor in which a semiconductor layer is formed of an oxide semiconductor. The oxide semiconductor may include, for example, an oxide based on titanium (Ti), hafnium (Hf), zirconium (Zr), aluminum (Al), tantalum (Ta), germanium (Ge), zinc (Zn), gallium (Ga), tin (Sn), or indium (In), and complex oxides thereof such as zinc oxide (ZnO), indium-gallium-zinc oxide (InGaZnO4), indium-zinc oxide (Zn—In—O), zinc-tin oxide (Zn—Sn—O), indium-gallium oxide (In—Ga—O), indium-tin oxide (In—Sn—O), indium-zirconium oxide (In—Zr—O), indium-zirconium-zinc oxide (In—Zr—Zn—O), indium-zirconium-tin oxide (In—Zr—Sn—O), indium-zirconium-gallium oxide (In—Zr—Ga—O), indium-aluminum oxide (In—Al—O), indium-zinc-aluminum oxide (In—Zn—Al—O), indium-tin-aluminum oxide (In—Sn—Al—O), indium-aluminum-gallium oxide (In—Al—Ga—O), indium-tantalum oxide (In—Ta—O), indium-tantalum-zinc oxide (In—Ta—Zn—O), indium-tantalum-tin oxide (In—Ta—Sn—O), indium-tantalum-gallium oxide (In—Ta—Ga—O), indium-germanium oxide (In—Ge—O), indium-germanium-zinc oxide (In—Ge—Zn—O), indium-germanium-tin oxide (In—Ge—Sn—O), indium-germanium-gallium oxide (In—Ge—Ga—O), titanium-indium-zinc oxide (Ti—In—Zn—O), hafnium-indium-zinc oxide (Hf—In—Zn—O), or a combination thereof.

The semiconductor layer includes a channel region where no impurity is doped, and source and drain regions at respective sides of the channel region where impurities are doped. The impurities may be dependent upon types of the thin film transistor, and N-type impurities or P-type impurities may be accordingly applicable. When the semiconductor layer includes an oxide semiconductor, an additional protective layer may be added to protect the oxide semiconductor from being vulnerable to high temperatures or other environmental effects.

The liquid crystal capacitor Clc includes two terminals such as a pixel electrode PE of the thin film transistor array panel 10 and a common electrode CE of the common electrode panel 20. The liquid crystal layer 15 functions as a dielectric between the pixel electrode PE and the common electrode CE. The liquid crystal layer 15 may have dielectric anisotropy. The pixel electrode PE is coupled to the switching element Q, and the common electrode CE is formed on a front surface of the common electrode panel 20 and is applied with the common voltage Vcom.

Unlike FIG. 2, the common electrode CE may be provided in the thin film transistor array panel 10. In this case, at least one of two electrodes PE and CE may be formed in the shape of a line or rod.

The liquid crystal capacitor Clc, which performs an auxiliary function of the storage capacitor Cst, may be formed such that an additional signal line provided in the thin film transistor array panel 10 overlaps the pixel electrode PE with an interposing insulator. A predetermined voltage (e.g., common voltage Vcom) may be applied to the additional signal line.

A color filter CF may be formed at a region of the common electrode CE of the common electrode panel 20. Each pixel PX may display a predetermined color, and thus a desired color may be recognizable using a spatial sum of the primary colors. Each pixel PX may be set to alternatingly display one of a predetermined number of primary colors over time. Thus, a desired color is recognizable using a temporal sum of the primary colors. Examples of the primary colors include red, green, and blue.

As an example of a spatial division, each pixel PX may be provided with a color filter CF for displaying one of the primary colors in a region of the common electrode panel 20 that corresponds to the pixel electrode PE. Alternatively, the color filter CF may be formed above or below the pixel electrode PE of the thin film transistor array panel 10.

A common voltage generator and a method using the same will now be described. Here, a first common voltage is applied to a common electrode CE for a first period after a power supply is turned on. Then, a second common voltage is applied to the common electrode CE until the power supply is turned off after the first period.

Figure 3:
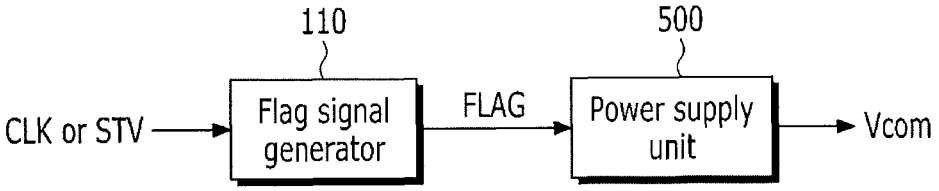
FIG. 3 illustrates an embodiment of a common voltage generator.
Figure 4:
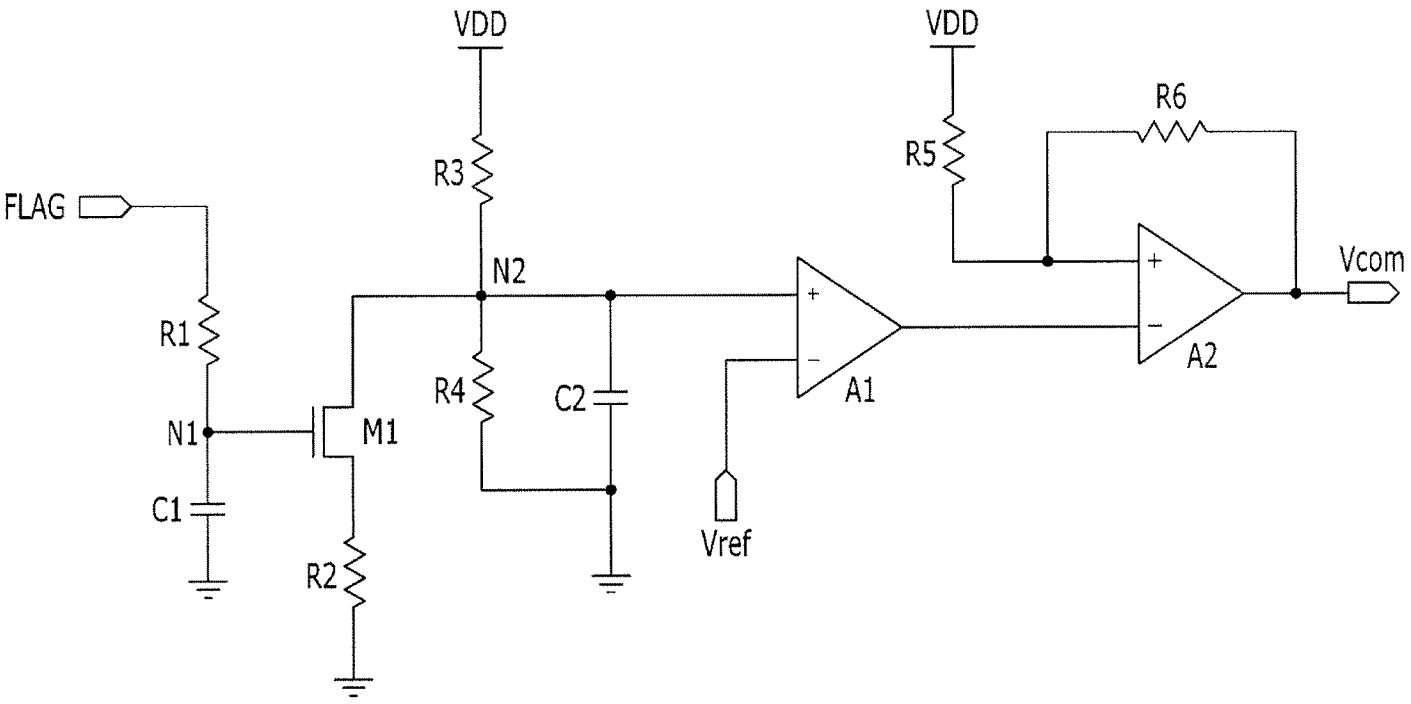
FIG. 4 illustrates an embodiment of a power supply.
Figure 5:
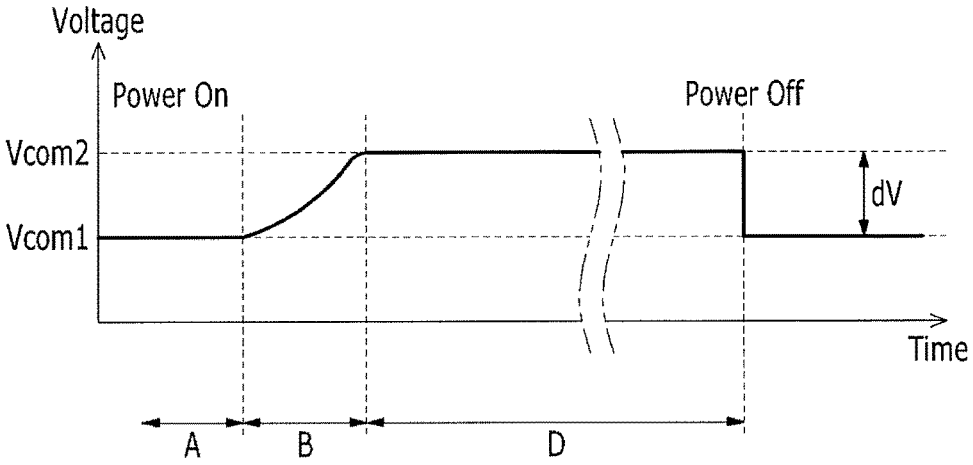
FIG. 5 illustrates an embodiment of a method for driving a display device.

FIG. 3 illustrates an embodiment of a common voltage generator, FIG. 4 illustrates an embodiment of a power supply, and FIG. 5 is a timing diagram illustrating signals used by one embodiment of a method for driving the display device.

Referring to FIGS. 3 to 5, the common voltage generator includes a flag signal generator 110 and a power supply unit 500. The flag signal generator 110 receives at least one of a clock signal CLK or a scan start signal STV, and measures a first period A from at least one of the clock signal CLK or the scan start signal STV. The clock signal CLK may be generated inside the signal controller 100 or based on a main clock signal MCLK received, for example, from an external source.

The flag signal generator 110 measures a first period A to generate a flag signal FLAG for instructing generation of one of a first common voltage Vcom1 or a second common voltage Vcom2. The flag signal is transmitted to the power supply unit 500.

The flag signal generator 110 transmits the flag signal FLAG for instructing generation of the first common voltage Vcom1 to the power supply unit 500 at a predetermined time, e.g., when the power supply is turned on. The power supply unit 500 generates the first common voltage Vcom1 according to the flag signal FLAG.

The flag signal generator 110 transmits the flag signal FLAG for instructing generation of the second common voltage Vcom2 to the power supply unit 500 at a predetermined time, e.g., when the first period A elapses after the power supply is turned on. The power supply unit 500 generates the second common voltage Vcom2 according to the flag signal FLAG.

The power supply unit 500 may be configured, for example, to increase the first common voltage Vcom1 to the second common voltage Vcom2 at a predetermined rate in a predetermined second period B. The predetermined rate may be a relatively slow rate. The power supply unit 500 generates the second common voltage Vcom2 for a driving period D, which may start from a time when the second period B elapses to a time when the power supply is turned off.

When the power supply is turned off, the flag signal generator 110 transmits the flag signal FLAG for instructing the generation of the first common voltage Vcom1 to the power supply unit 500. The power supply unit 500 changes the second common voltage Vcom2 to the first common voltage Vcom1 according to the flag signal FLAG.

When the display device is driven for a long time, a driven pattern affects transmittance of the panel and a residual image may remain even after the display device is turned off and then turned on again. The residual image disappears as the display device is slowly driven. The first period is based on a time required for the residual image to disappear as the display device is driven. The first period is a predetermined value, which, for example, may be experimentally determined or otherwise set. In one embodiment, the first period may be set to approximately 30 minutes to one hour.

The predetermined first common voltage Vcom1 may be determined to reduce or minimize the residual image. The predetermined first common voltage Vcom1 may also be experimentally or otherwise set to some fixed value. In one embodiment, the first common voltage Vcom1 may be set to approximately set to be lower by about 20 mV to 40 mV than the second common voltage Vcom2, e.g., a voltage difference dV between the first common voltage Vcom1 and the second common voltage Vcom2 may be about 20 mV to 40 mV.

Referring to FIG. 4, an example of a circuit of the power supply unit 500 is illustrated for variably generating the common voltage Vcom as the first common voltage Vcom1 and the second common voltage Vcom2 according to the flag signal FLAG.

The power supply unit 500 includes a plurality of resistors R1 to R6, a plurality of capacitors C1 and C2, and a switching transistor M1, and a plurality of differential amplifiers A1 and A2. The first resistor R1 includes one end coupled to the input terminal to which the flag signal FLAG is input. The other end is coupled to a first node N1. The first capacitor C1 includes one electrode coupled to the first node N1. The other electrode is coupled to a ground.

The switching transistor M1 includes a gate electrode coupled to the first node N1, a first electrode coupled to a second node N2, and a second electrode coupled to one end of the second resistor R2. The second resistor R2 includes one end coupled to the switching transistor M1. The other end is coupled to the ground. The third resistor R3 includes one end coupled to a power supply voltage VDD. The other end is coupled to the second node N2. The power supply voltage VDD may be a high level voltage. The fourth resistor R4 includes one end coupled to the second node N2. The other end is coupled to the ground.

A first differential amplifier A1 includes a first input terminal (+) to which a voltage of the second node N2 is input, a second input terminal (−) to which a reference voltage Vref is input, and an output terminal from which a first differential voltage between the voltage of the second node N2 and the reference voltage Vref is output. The reference voltage Vref may be a predetermined voltage, e.g., a low level voltage. For example, the reference voltage Vref may be set to be a ground voltage.

The second capacitor C2 includes one electrode coupled to the second node N2. The other electrode is coupled to ground.

A second differential amplifier A2 includes a first input terminal (−) coupled to the output terminal of the first differential amplifier A1 to receive the first differential voltage, a second input terminal (+) coupled to the other end of the fifth resistor to receive the power supply voltage VDD, and an output terminal that outputs, as the common voltage Vcom, a second differential voltage between the first differential voltage and the power supply voltage VDD.

The fifth resistor R5 includes one end coupled to the power supply voltage VDD. The other end is coupled to the second input terminal (+) of the second differential amplifier A2. The sixth resistor R6 includes one end coupled to the second input terminal (+) of the second differential amplifier A2. The other end is coupled to an output terminal of the second differential amplifier A2.

The switching transistor M1 may be an n-channel field effect transistor that is turned on by a high level voltage and is turned off by a low level voltage. Alternatively, the switching transistor M1 may be a p-channel field effect transistor that is turned on by the low level voltage and is turned off by the high level voltage. In this case, the switching transistor M1 is assumed to be an n-channel field effect transistor.

First, a case in which the flag signal FLAG is received as the low level voltage will be described. The voltage of the first node N1 is set to the low level voltage and the switching transistor M1 is turned off. The voltage of the second node N2 is divided by the third resistor R3 and the fourth resistor R4. The first differential voltage between the voltage of the second node N2 and the reference voltage Vref is input to the first input terminal (−) of the second differential amplifier A2. The second differential voltage, corresponding to the difference between the first differential voltage and the power supply voltage VDD, is output as the first common voltage Vcom1.

Next, a case in which the flag signal FLAG is received as the high level voltage will be described. When receiving the flag signal FLAG changed from the low level voltage to the high level voltage, the first capacitor C1 is charged to the high level voltage. The voltage of first node N1 slowly increases to the high level voltage, because it is delayed by a time required for the first capacitor C1 to be charged.

The delay time for the voltage of the first node N1 to reach the high level voltage may correspond to the second period B, during which the first common voltage Vcom1 slowly increases to the second common voltage Vcom2. The second period B may be dependent upon the resistance of the first resistor R1 and capacitance of first capacitor C1. As the voltage of the first node N1 slowly increases, the amount of current flowing through the switching transistor M1 slowly increases.

The voltage of the second node N2 is divided by the second resistor R2, the third resistor R3, and the fourth resistor R4. Because the second resistor R2 and the fourth resistor R4 are connected in parallel, the voltage of the second node N2 becomes a relatively low voltage compared with the case in which the switching transistor M1 is turned off. As the voltage of the second node N2 becomes the relatively low voltage, the first differential voltage output from the first differential amplifier A1 also becomes the relatively low voltage. As the first differential voltage becomes the low voltage, the second differential voltage output from the second differential amplifier A2 is a relatively high second common voltage Vcom2.

As the flag signal generator 110 transmits the flag signal FLAG of the low level voltage to the power supply unit 500 for the first period A, the first common voltage Vcom1 may be output. Then, after the first period A, as the flag signal generator 110 transmits the flag signal FLAG of the high level voltage to the power supply unit 500, the first common voltage Vcom1 slowly increases to the second common voltage Vcom2 for the second period B. The second common voltage Vcom2 may be generated for the driving period D.

The flag signal generator 110 may be included in the signal controller 100. In this case, the flag signal FLAG may be in the power supply control signal CONT3 transmitted from the signal controller 100 to the power supply unit 500. Alternatively, the flag signal generator 110 may be in the power supply unit 500. In this case, the power supply control signal CONT3 may include at least one of the clock signal CLK or the scan start signal STV.

Figure 6:
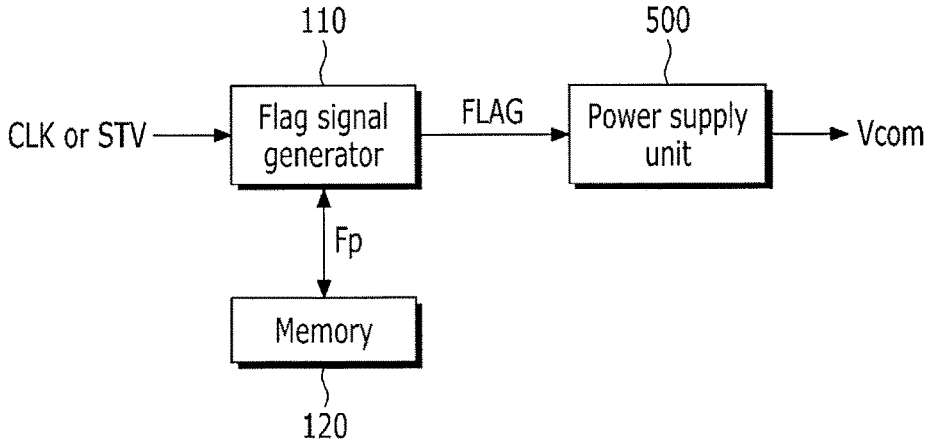
FIG. 6 illustrates another embodiment of a common voltage generator.
Figure 7:
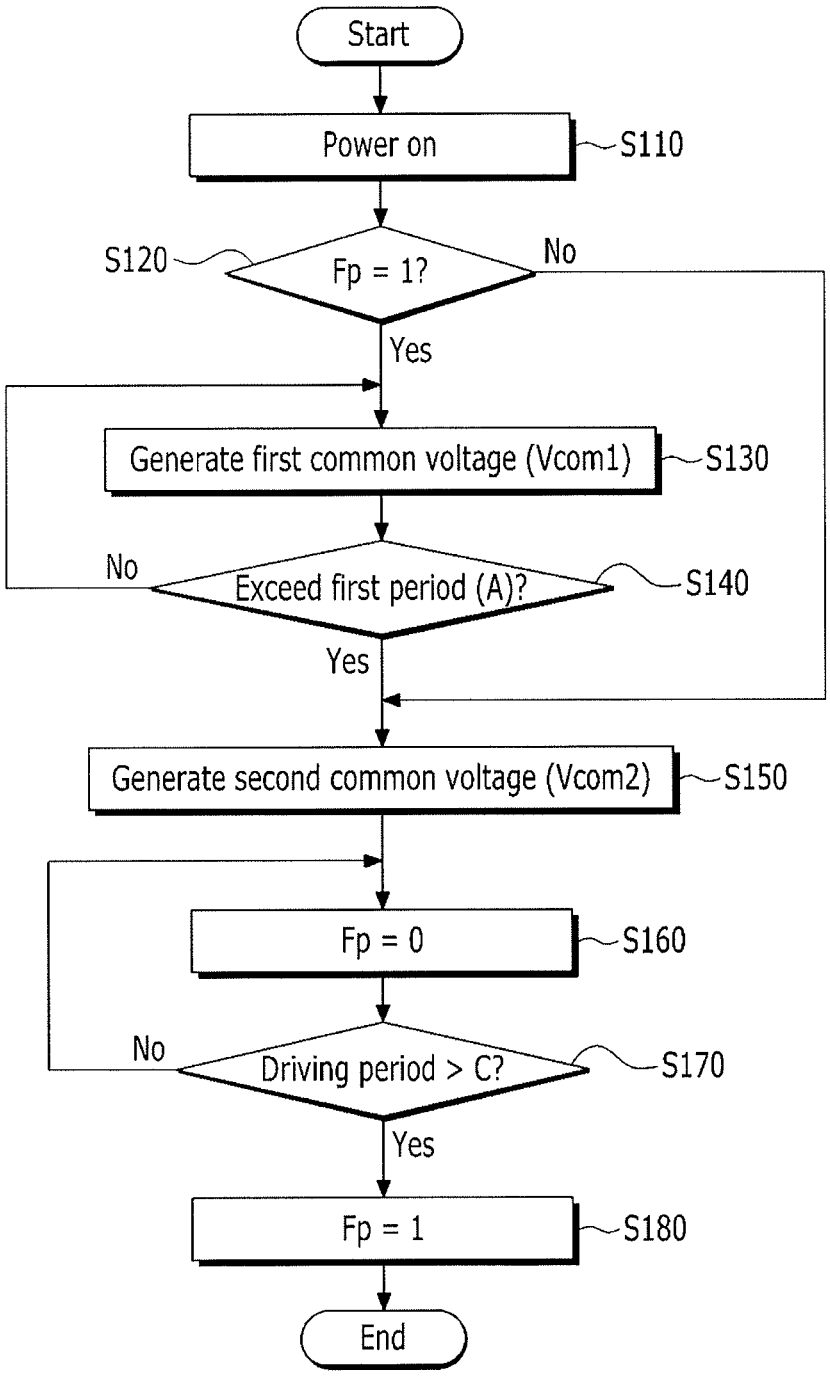
FIG. 7 illustrates another embodiment of a method for driving a display device.
Figure 8:
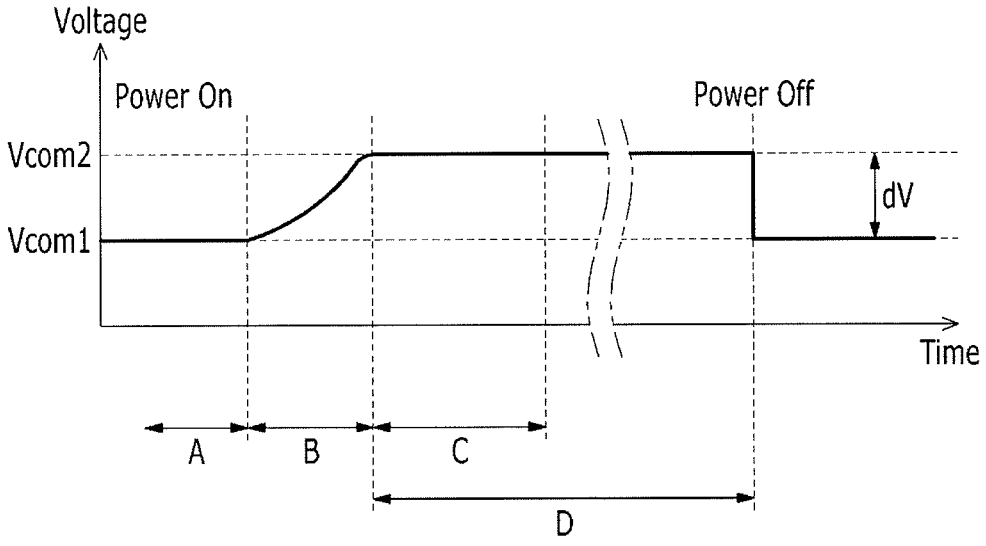
FIG. 8 illustrates another embodiment of a method for driving a display device.

FIG. 6 illustrates another embodiment of a common voltage generator, FIG. 7 illustrates another embodiment of a method for driving a display device, and FIG. 8 is a timing including signals generated by the driving method of FIG. 7.

Referring to FIGS. 6 to 8, the common voltage generator includes a flag signal generator 110, a memory 120, and a power supply unit 500. Compared with the common voltage generator in FIGS. 3 to 5, this embodiment of the common voltage generator includes a memory 120 for storing a flag parameter Fp. The memory 120 may be, for example, a nonvolatile memory such as an electrically erasable programmable read-only memory (EEPROM) for storing the flag parameter Fp, even when disconnected from the power supply.

The flag parameter Fp may be determined by the driving period D for which the second common voltage Vcom2 is applied. The flag parameter Fp may be represented, for example, by one bit, which is set to 1 for instructing generation of the first common voltage Vcom1 or 0 for instructing generation of the second common voltage Vcom2.

The flag signal generator 110 reads the flag parameter Fp from the memory 120 at a predetermined time, e.g., when the power supply is turned on. The flag signal generator 110 transmits the flag signal FLAG for instructing generation of the first common voltage Vcom1 to the power supply unit 500 when the flag parameter Fp is set to 1, or transmits the flag signal FLAG for instructing generation of the second common voltage Vcom2 to the power supply when the flag parameter Fp is set to 0.

Then, the flag signal generator 110 sets the flag parameter Fp to 1 when the driving period D, for which the second common voltage Vcom2 is applied, exceeds a predetermined third period C. The flag signal generator 110 sets the flag parameter Fp to 0 when the driving period does not exceed the third period C.

During the driving period D, even if the flag parameter Fp is changed, the second common voltage Vcom2 is output as it is. The flag signal generator 110 and the memory 120 may be included, for example, in the signal controller 100. In this case, the flag signal FLAG may be included in the power supply control signal CONT3 transmitted from the signal controller 100 to the power supply unit 500.

Alternatively, the flag signal generator 110 and the memory 120 may be in the power supply unit 500. In this case, the power supply control signal CONT3 may include at least one of the clock signal CLK or the scan start signal STV.

Referring to FIG. 7, the driving method for generating the first common voltage Vcom1 or second common voltage Vcom2 using the flag parameter Fp includes turning on the power supply of the display device (S110). When the power supply of the display device is turned on, the flag signal generator 110 determines whether the flag parameter Fp stored in the memory 120 is set to 1 (S120).

When the flag parameter Fp stored in the memory 120 is set to 1, the flag signal generator 110 transmits the flag signal FLAG of the low level voltage for instructing the generation of the first common voltage Vcom1 to the power supply unit 500, and the power supply unit 500 generates the first common voltage Vcom1 (S130).

After generating the first common voltage Vcom1, the flag signal generator 110 determines whether the first period A is elapsed (S140). The flag signal generator 110 generates the first common voltage Vcom1 until the first period A elapses after the power supply is turned on.

The flag signal generator 110 transmits the flag signal FLAG of the high level voltage for instructing the generation of the second common voltage Vcom2 to the power supply unit 500 when the first period A elapses, and the power supply unit 500 generates the second common voltage Vcom2 (S150).

When the flag signal FLAG of the high level voltage is transmitted to the power supply unit 500, an output voltage of the power supply unit 500 slowly increases from the first common voltage Vcom1 to the second common voltage Vcom2 for the second period B.

The flag signal generator 110 sets the flag parameter Fp to 0 when the first period A elapses, and stores the flag parameter Fp in the memory 120 (S160). The flag signal generator 110 determines whether the driving period D for which the second common voltage Vcom2 is applied exceeds the predetermined third period C (S170).

The third period C is a predetermined period for which, for example, the residual image may appear due to long hours of driving. For example, the third period C may be approximately set to 4 hours. The flag signal generator 110 sets the flag parameter Fp to 0 as it is, when the driving period D does not exceed the third period C.

The flag signal generator 110 sets the flag parameter Fp to 1 when the driving period D exceeds the third period C, and stores it in the memory 120 (S180). In this case, the flag signal generator 110 transmits the flag signal FLAG of the high level voltage to the power supply unit 500, even when the flag parameter Fp is set to 1. This allows the second common voltage Vcom2 to be continuously generated.

When the flag parameter Fp stored in the memory 120 is set to 0 at a time when the power supply of the display device is turned on, the flag signal generator 110 transmits the flag signal FLAG of the high level voltage for instructing the generation of second common voltage Vcom2 to the power supply unit 500. For example, when the flag parameter Fp stored in the memory 120 is not set to 1 at a time when the power supply is turned on, the first period A (for which the first common voltage Vcom1 is generated) and the second period B (for which the first common voltage Vcom1 increases to the second common voltage Vcom2) are omitted, and the second common voltage Vcom2 is directly generated.

Figure 9:
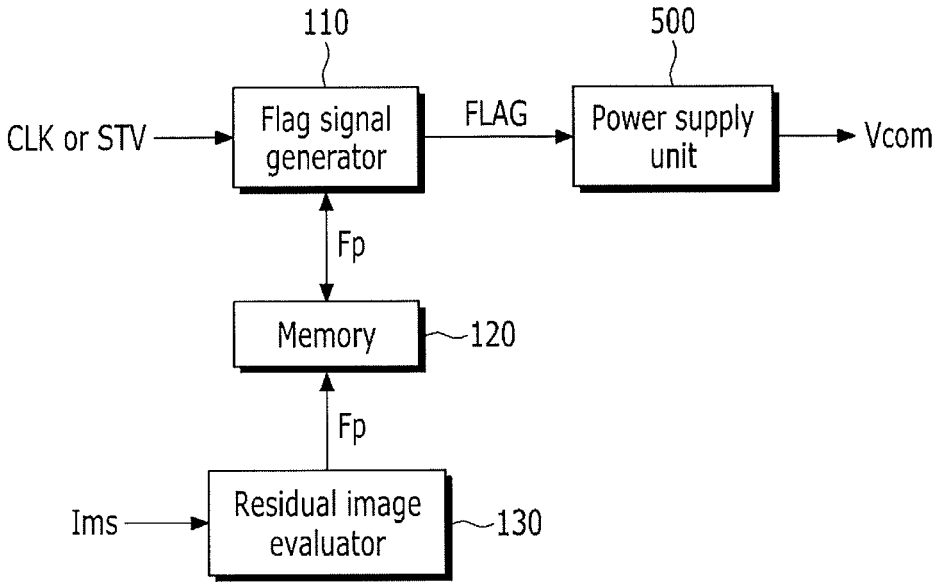
FIG. 9 illustrates another embodiment of a common voltage generator.
Figure 10:
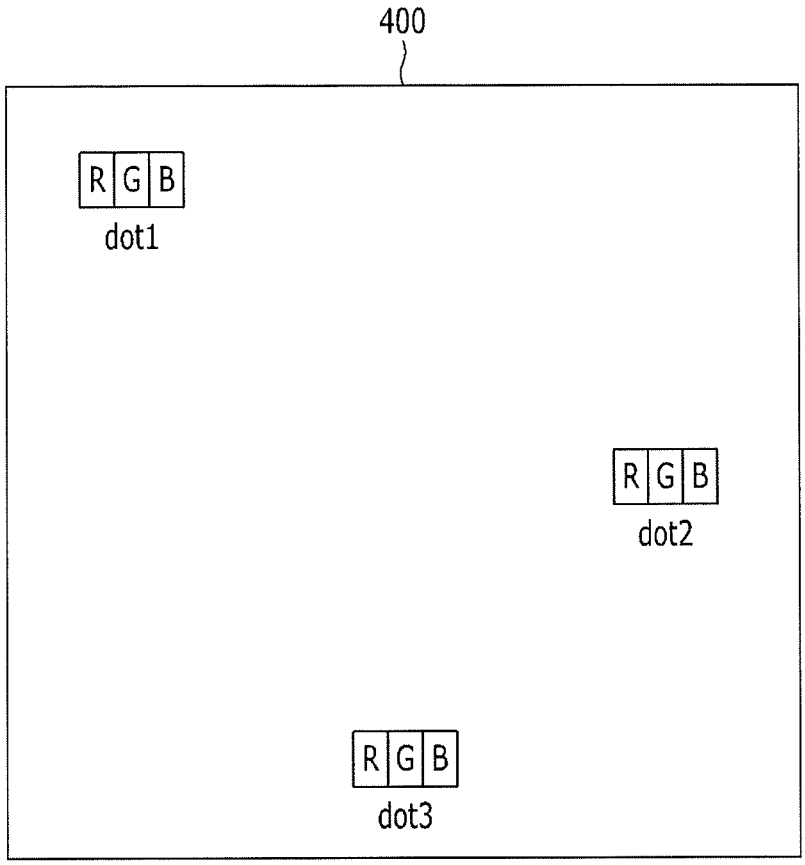
FIG. 10 illustrates an embodiment of a method for evaluating a residual image.
Figure 11:
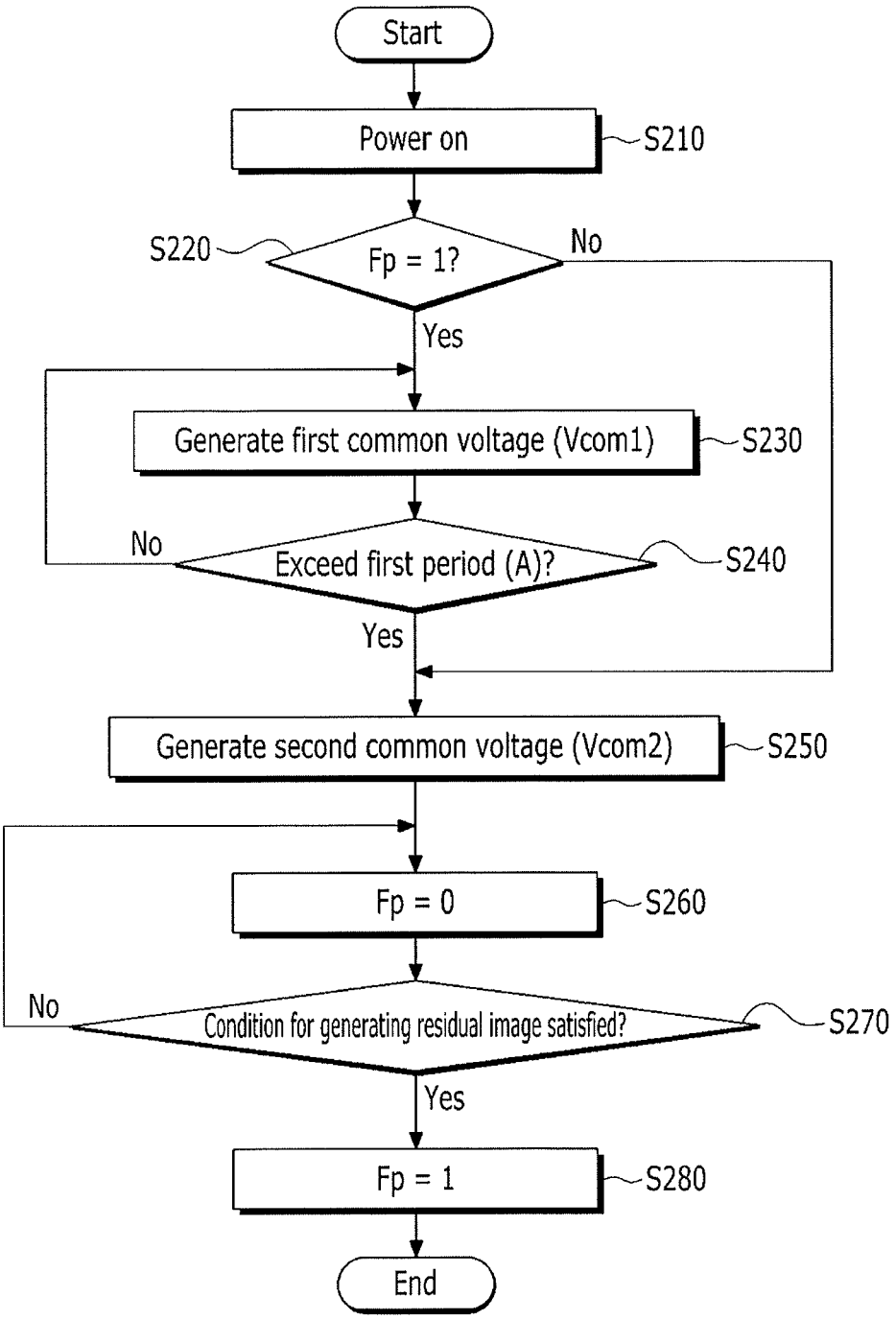
FIG. 11 illustrates another embodiment of a method for driving a display device.
Figure 12:
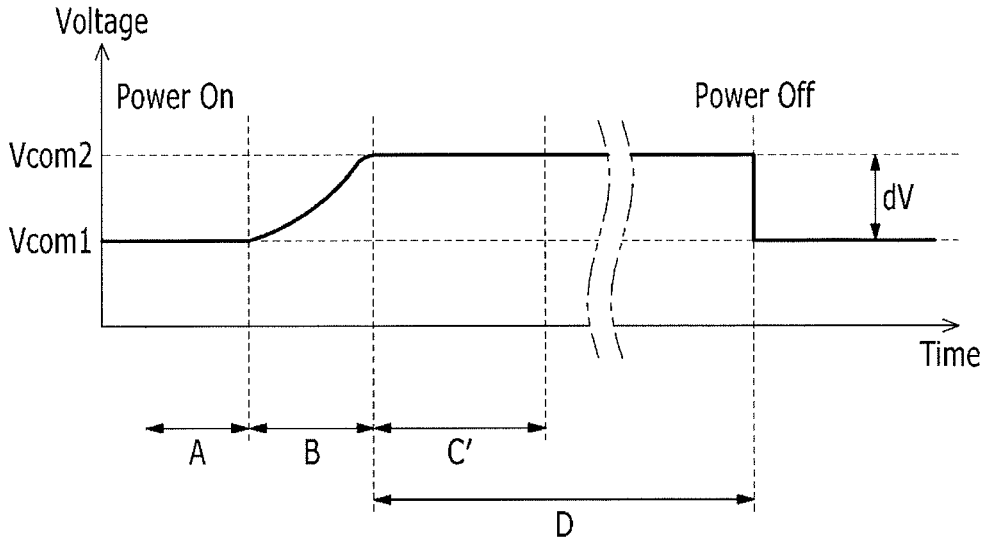
FIG. 12 illustrates an example of signals for controlling a display device.

FIG. 9 illustrates another embodiment of a common voltage generator, and FIG. 10 illustrates an embodiment of a method for evaluating a residual image. FIG. 11 illustrates another embodiment of a method for driving a display device, and FIG. 12 is a timing diagram including control signals to be used by the driving method.

Referring to FIGS. 9 to 12, the common voltage generator includes a flag signal generator 110, a memory 120, a residual image evaluator 130, and a power supply unit 500. Compared to the common voltage generator described in FIGS. 3 to 5, the common voltage generator further includes the memory 120 and the residual image evaluator 130.

The memory 120 stores a flag parameter Fp, which may be determined by a condition for generating a residual image that is evaluated by the residual image evaluator 130. The flag parameter Fp may be represented, for example, by one bit, which is set to 1 for instructing the generation of the first common voltage Vcom1 and to 0 for instructing the generation of the second common voltage Vcom2.

The memory 120 may be, for example, a nonvolatile memory such as an EEPROM. The residual image evaluator 130 detects whether identical image signals ImS are received for a plurality of frames, in order to evaluate whether the condition for generating a residual image is satisfied.

Referring to FIG. 10, the residual image evaluator 130 checks whether the image signals ImS received by a dot1, a dot2, and a dot3 at specific locations are identically received for a predetermined number of frames. The flag parameter Fp is set based on the result. The dot1, dot2, and dot3 refer, for example, to a unit by which a red pixel R, a green pixel G, and a blue pixel B adjacent to each other are spatially or temporally summed to be recognized as one color.

The residual image evaluator 130 sets the flag parameter Fp to 1 for instructing the generation of the first common voltage Vcom1 when the image signals ImS received by the dot1, dot2, and dot3 at the specific locations are identically received for the predetermined number of frames.

The residual image evaluator 130 sets the flag parameter Fp to 0 for instructing the generation of the second common voltage Vcom2 when the image signals ImS received by the dot1, dot2, and dot3 dot at the specific locations are differently received for the predetermined number of frames.

The flag signal generator 110 reads the flag parameter Fp from the memory 120 when the power supply is turned on. The flag signal generator 110 transmits the flag signal FLAG for instructing the generation of the first common voltage Vcom1 to the power supply unit 500 when the flag parameter Fp is set to 1, or transmits the flag signal FLAG for instructing the generation of the second common voltage Vcom2 to the power supply when the flag parameter Fp is set to 0.

After generating the first common voltage Vcom1, the flag signal generator 110 transmits the flag signal FLAG for instructing generation of the second common voltage Vcom2 to the power supply when the first period A is elapsed. This allows the second common voltage Vcom2 to be generated.

The flag signal generator 110, the memory 120, and the residual image evaluator 130 may be included, for example, in the signal controller 100. In this case, the flag signal FLAG may be included in the power supply control signal CONT3 transmitted from the signal controller 100 to the power supply unit 500.

Alternatively, the flag signal generator 110, the memory 120, and the residual image evaluator 130 may be in the power supply unit 500. In this case, the power supply control signal CONT3 may include at least one of the clock signal CLK or the scan start signal STV, and the image signal ImS.

Referring to FIG. 11, the driving method for generating the first common voltage Vcom1 or second common voltage Vcom2 using the flag parameter Fp includes turning on the power supply of the display device (S210). When the power supply of the display device is turned on, the flag signal generator 110 determines whether the flag parameter Fp stored in the memory 120 is set to 1 (S220).

When the flag parameter Fp stored in the memory 120 is set to 1, the flag signal generator 110 transmits the flag signal FLAG of the low level voltage for instructing the generation of the first common voltage Vcom1 to the power supply unit 500, and the power supply unit 500 generates the first common voltage Vcom1 (S230).

After generating the first common voltage Vcom1, the flag signal generator 110 determines whether the first period A has elapsed (S240). The flag signal generator 110 generates the first common voltage Vcom1 until the first period A elapses after the power supply is turned on.

The flag signal generator 110 transmits the flag signal FLAG of the high level voltage for instructing the generation of the second common voltage Vcom2 to the power supply unit 500 when the first period A is elapsed, and the power supply unit 500 generates the second common voltage Vcom2 (S250).

When the flag signal FLAG of the high level voltage is transmitted to the power supply unit 500, an output voltage of the power supply unit 500 slowly increases from the first common voltage Vcom1 to the second common voltage Vcom2 for the second period B. The flag signal generator 110 sets the flag parameter Fp to 0 when the first period A is elapsed, and stores it in the memory 120 (S260).

The residual image evaluator 130 detects whether identical image signals ImS are received for a plurality of frames C', to evaluate whether a condition for generating a residual image is satisfied (S270). The residual image evaluator 130 checks if the image signals ImS received by a dot1, a dot2, and a dot3 at specific locations are identically received for a predetermined number of frames C, to thereby set the flag parameter Fp.

The residual image evaluator 130 may set the flag parameter Fp to 0 for instructing the generation of the second common voltage Vcom2 if respective different image signals ImS are received for a plurality of frames.

The residual image evaluator 130 sets the flag parameter Fp to 1 for instructing the generation of the first common voltage Vcom1 when the image signals ImS received by the dot1, dot2, and dot3 at the specific locations are identically received for the predetermined number of frames C' (S280). In this case, the flag signal generator 110 transmits the flag signal FLAG of the high level voltage to the power supply unit 500, even when the flag parameter Fp is set to 1. This allows the second common voltage Vcom2 to be continuously generated.

When the flag parameter Fp stored in the memory 120 is set to 0 at a time when the power supply of display device is turned on, the flag signal generator 110 transmits the flag signal FLAG of the high level voltage for instructing the generation of the second common voltage Vcom2 to the power supply unit 500. For example, when the flag parameter Fp stored in the memory 120 is not set to 1 at a time when the power supply is turned on, the first period A (for which the first common voltage Vcom1 is generated) and the second period B (for which the first common voltage Vcom1 increases to the second common voltage Vcom2) are omitted, and the second common voltage Vcom2 is directly generated.

By way of summation and review, when the LCD is driven for a long time, a driven pattern may affect the transmittance in a way that deteriorates display quality. Also, when the same pattern is continuously displayed, a residual afterimage of the pattern may remain. Also, a common voltage does not change for removing a residual image to improve display quality.

In accordance with one or more of the aforementioned embodiments, a display device and a driving method removes a residual image to improve display quality, even when the display device driven for a long time (e.g., hours). Moreover, in accordance with one or more of the aforementioned embodiments, a power supply unit applies a first common voltage to the common electrode for a first period after a power supply is turned on, and applies a second common voltage higher than the first common voltage to the common electrode until the power supply is turned off after the first period.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

Also, another embodiment may include a computer-readable medium, e.g., a non-transitory computer-readable medium, for storing the code or instructions described above. The computer-readable medium may be a volatile or non-volatile memory or other storage device, which may be removably or fixedly coupled to the computer, processor, controller, or other signal processing device which is to execute the code or instructions for performing the method embodiments described herein.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A display device, comprising:

a display including a plurality of pixels, each including a liquid crystal layer between a pixel electrode and a common electrode; and a power supply to apply common voltages to the common electrode, wherein the power supply is to apply a first common voltage to the common electrode for a first period after power is turned on, and is to apply a second common voltage higher than the first common voltage to the common electrode from a time after the first period to a time when the power is turned off, wherein the first common voltage is a non-zero voltage and the first period includes a time sufficient to reduce a residual image at the first common voltage.

2. The device as claimed in claim 1, wherein the second common voltage is set to a voltage to reduce flicker at a predetermined gray scale value.

3. The device as claimed in claim 1, wherein the power supply increases the first common voltage to the second common voltage at a predetermined rate for a predetermined second period.

4. The device as claimed in claim 1, further comprising:

a flag signal generator to measure the first period from at least one of a clock signal or a scan start signal, and to generate a flag signal for instructing generation of one of the first common voltage or the second common voltage.

5. The device as claimed in claim 4, further comprising:

a memory to store a flag parameter determined by a driving period for which the second common voltage is applied.

6. The device as claimed in claim 5, wherein the flag signal generator is to:

set the flag parameter to 1 for instructing generation of the first common voltage when the driving period for which the second common voltage is applied exceeds a predetermined third period, and set the flag parameter to 0 for instructing generation of the second common voltage when the driving period does not exceed the third period.

7. The device as claimed in claim 6, wherein the flag signal generator is to:

read the flag parameter from the memory when the power supply is turned on, and transmit a first flag signal for generating the first common voltage when the flag parameter is set to 1, or transmit a second flag signal for generating the second common voltage when the flag parameter is set to 0 to the power supply.

8. The device as claimed in claim 4, further comprising:

a residual image evaluator to evaluate whether a condition for generating a residual image is satisfied by detecting whether identical image signals are received for a plurality of frames; and a memory to store a flag parameter determined by whether the condition for generating a residual image is satisfied.

9. The device as claimed in claim 8, wherein the residual image evaluator is to:

set the flag parameter to 1 for instructing the generation of the first common voltage when image signals input to a dot at a specific location are identically received for a predetermine number of frames, and set the flag parameter to 0 for instructing the generation of the second common voltage when the image signals input to the dot at the specific location are differently received for a plurality of frames.

10. The device as claimed in claim 9, wherein the flag signal generator is to:

read the flag parameter from the memory when the power supply is turned on, and transmit a first flag signal for generating the first common voltage when the flag parameter is set to 1, or transmit a second flag signal for generating the second common voltage when the flag parameter is set to 0 to the power supply.

11. The device as claimed in claim 4, wherein the power supply includes:

a first resistor including a first end coupled to an input terminal to which the flag signal is input and a second end coupled to a first node;

a first capacitor including a first electrode coupled to the first node and a second electrode coupled to a reference potential;

a switching transistor including a gate electrode coupled to the first node and a first electrode coupled to a second node;

a second resistor including a first end coupled to a second electrode of the switching transistor and a second end coupled to the reference potential;

a third resistor power including a first end coupled to a power supply voltage and a second end coupled to the second node;

a fourth resistor including a first end coupled to the second node and a second end coupled to the reference potential; and a first differential amplifier to output a first differential voltage between a voltage of the second node and a reference voltage.

12. The device as claimed in claim 11, wherein the power supply includes a second capacitor having a first electrode coupled to the second node and a second electrode coupled to the reference potential.

13. The display device as claimed in claim 12, wherein the power supply includes a second differential amplifier which includes:

a first input terminal to which the first differential voltage is input;

a second input terminal to which the power supply voltage is input; and an output terminal to output, as the common voltage, a second voltage based on a difference between the first differential voltage and the power supply voltage.

14. The device as claimed in claim 13, wherein the power supply includes:

a fifth resistor coupled between the power supply voltage and a second input terminal of the second differential amplifier; and a sixth resistor coupled between the second input terminal of the second differential amplifier and an output terminal of the second differential amplifier.

15. A method for driving a liquid crystal display device, the method comprising:

applying a first common voltage to a common electrode for a first period after a power supply is turned on; and applying a second common voltage higher than the first common voltage to the common electrode from a time after the first period to a time when the power supply is turned off, wherein the first common voltage is a non-zero voltage and the first period includes a time sufficient to reduce a residual image at the first common voltage.

16. The method as claimed in claim 15, further comprising:

increasing the first common voltage to the second common voltage at a predetermined rate for a predetermined second period.

17. The method as claimed in claim 15, further comprising:

setting a flag parameter to 1 for instructing generation of a first common voltage when a driving period, for which a second common voltage is applied, exceeds a predetermined third period, and setting the flag parameter to 0 for instructing generation of the second common voltage when the driving period exceeds the third period.

18. The method as claimed in claim 17, wherein applying the first common voltage to the common electrode for the first period after the power supply is turned on includes transmitting a first flag signal for instructing the generation of the first common voltage when the flag parameter is set to 1 when the power supply is turned on to the power supply.

19. The method as claimed in claim 17, wherein applying the first common voltage to the common electrode for the first period after the power supply is turned on is omitted when the flag parameter is set to 0 when the power supply is turned on.

20. The method as claimed in claim 15, further comprising:

setting a flag parameter to 1 for instructing the generation of the first common voltage when image signals input to a pixel at a specific location are identically received for a predetermined number of frames, and setting the flag parameter to 0 for instructing the generation of the second common voltage when the image signals input to the pixel at the specific location are differently received for a plurality of frames.

* * * * *